US010697736B2

(12) United States Patent
Saad

(10) Patent No.: US 10,697,736 B2
(45) Date of Patent: Jun. 30, 2020

(54) BALLISTIC PANEL FOR HEADWEAR

(71) Applicant: Daniel F. Saad, Greer, SC (US)

(72) Inventor: Daniel F. Saad, Greer, SC (US)

( * ) Notice: Subject to any disclaimer, the term of this patent is extended or adjusted under 35 U.S.C. 154(b) by 115 days.

(21) Appl. No.: 15/980,819

(22) Filed: May 16, 2018

(65) Prior Publication Data

US 2019/0353463 A1 Nov. 21, 2019

(51) Int. Cl.

| | |
|---|---|
| ***F41H 1/08*** | (2006.01) |
| ***A42B 1/06*** | (2006.01) |
| ***A42B 1/20*** | (2006.01) |
| ***A42B 1/24*** | (2006.01) |
| ***A42B 1/08*** | (2006.01) |

(52) U.S. Cl.

CPC ..... *F41H 1/08* (2013.01); *A42B 1/069* (2013.01); *A42B 1/08* (2013.01); *A42B 1/20* (2013.01); *A42B 1/24* (2013.01); *A42B 1/241* (2013.01)

(58) Field of Classification Search

CPC .. F41H 1/08; A42B 1/241; A42B 1/24; A42B 1/20; A42B 1/08; A42B 1/069

See application file for complete search history.

(56) References Cited

U.S. PATENT DOCUMENTS

| | | | | |
|---|---|---|---|---|
| 5,729,830 | A * | 3/1998 | Luhtala | A42B 1/066 2/195.1 |
| 6,499,145 | B1 * | 12/2002 | Kates | A42B 1/242 2/10 |
| 7,937,778 | B1 * | 5/2011 | Norton | A42B 1/08 2/175.4 |
| 8,613,114 | B1 * | 12/2013 | Olivares Velasco | A42B 3/125 2/411 |
| 8,739,316 | B1 * | 6/2014 | Norton | A42B 1/08 2/411 |
| 2011/0307997 | A1 * | 12/2011 | Blair | A42B 1/08 2/414 |
| 2014/0007324 | A1 * | 1/2014 | Svehaug | A42B 1/08 2/412 |

* cited by examiner

*Primary Examiner* — Khaled Annis
(74) *Attorney, Agent, or Firm* — Dority & Manning, P.A.

(57) ABSTRACT

A ballistic garment includes a fabric cap and a plurality of flexible ballistic panels. Each of the plurality of flexible ballistic panels has a bottom edge and an acutely pointed head that is spaced from the bottom head. The acutely pointed head of each of the plurality of flexible ballistic panels is positioned adjacent a top portion of the fabric cap. The bottom edge of each of the plurality of flexible ballistic panels positioned adjacent a bottom portion of the fabric cap.

17 Claims, 4 Drawing Sheets

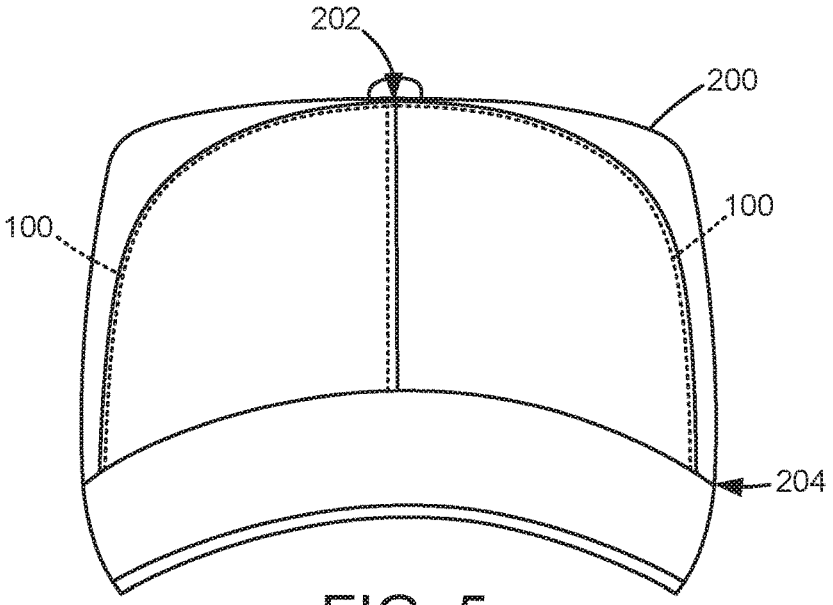
FIG. 5
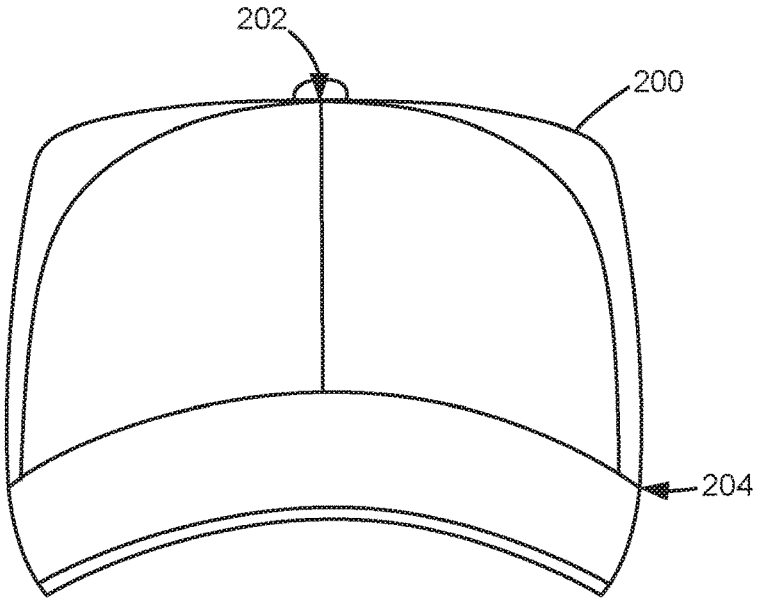
FIG. 6
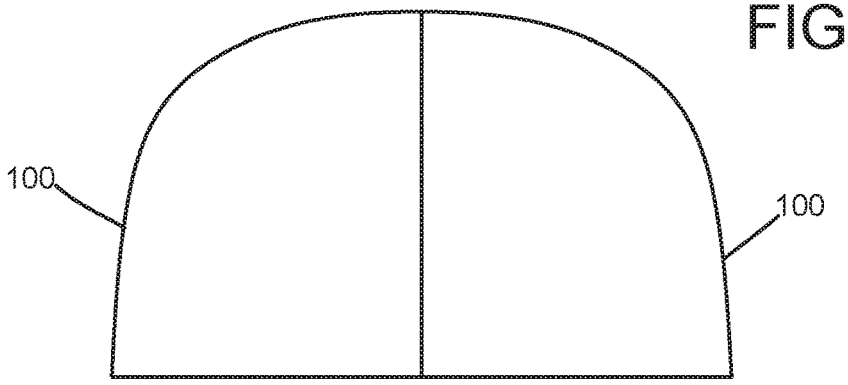

BALLISTIC PANEL FOR HEADWEAR

FIELD OF THE INVENTION

The present subject matter relates generally to ballistic panels, and headwear incorporating ballistic panels.

BACKGROUND OF THE INVENTION

Firearms are a known hazard to law enforcement officers. In 2016, one hundred and forty-three law enforcement officers died in the line of duty, and sixty-six of these deaths were attributed to lethal gunshot wounds. Law enforcement officers have worn ballistic vests for decades to reduce the risk of lethal gunshot wounds, but ballistic vests have limitations. In particular, ballistic vests protect torsos while leaving other body parts vulnerable to gunshot wounds.

The head is particularly vulnerable to gunshots, and known ballistic vests offer no head protection. Gunshot wounds to the head are associated with high risk of death or grave disability due to irreversible brain tissue damage. Ballistic helmets are available that can reduce head damage from gunshot wounds. However, police departments frequently limit the use of ballistic helmets because they can appear aggressive or militaristic to the public. Thus, ballistic helmets are generally only issued to Special Weapons and Tactics (SWAT) units in police departments. In addition, ballistic helmets can be heavy and cumbersome for constant wear while on duty.

BRIEF DESCRIPTION OF THE INVENTION

Aspects and advantages of the invention will be set forth in part in the following description, or may be apparent from the description, or may be learned through practice of the invention.

In a first example embodiment, a ballistic garment includes a fabric cap and a plurality of flexible ballistic panels. Each of the plurality of flexible ballistic panels has a bottom edge and an acutely pointed head that is spaced from the bottom head. The acutely pointed head of each of the plurality of flexible ballistic panels is positioned adjacent a top portion of the fabric cap. The bottom edge of each of the plurality of flexible ballistic panels positioned adjacent a bottom portion of the fabric cap. The plurality of flexible ballistic panels includes no less than six flexible ballistic panels.

In a second example embodiment, a ballistic garment includes a fabric cap and a plurality of flexible ballistic panels. Each of the plurality of flexible ballistic panels has a bottom edge and an acutely pointed head that is spaced from the bottom head. The acutely pointed head of each of the plurality of flexible ballistic panels is positioned adjacent a top portion of the fabric cap. The bottom edge of each of the plurality of flexible ballistic panels is positioned adjacent a bottom portion of the fabric cap. Each of the plurality of flexible ballistic panels also has a first side edge and a second side edge. The first and second side edges extend from the bottom edge to the acutely pointed head in each of the plurality of flexible ballistic panel. The first side edge of each of the plurality of flexible ballistic panels is positioned adjacent the second side edge of a respective one of the plurality of flexible ballistic panels such that the plurality of flexible ballistic panels are distributed around an interior of the fabric cap. The plurality of flexible ballistic panels includes no less than six flexible ballistic panels.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 5 is a front elevation view of a fabric cap with a plurality of the example flexible ballistic panels of FIG. 1 positioned within the fabric cap.

FIG. 6 is a front elevation view of the fabric cap of FIG. 5 with the plurality of example flexible ballistic panels removed from the fabric cap.

DETAILED DESCRIPTION

Figure 1:
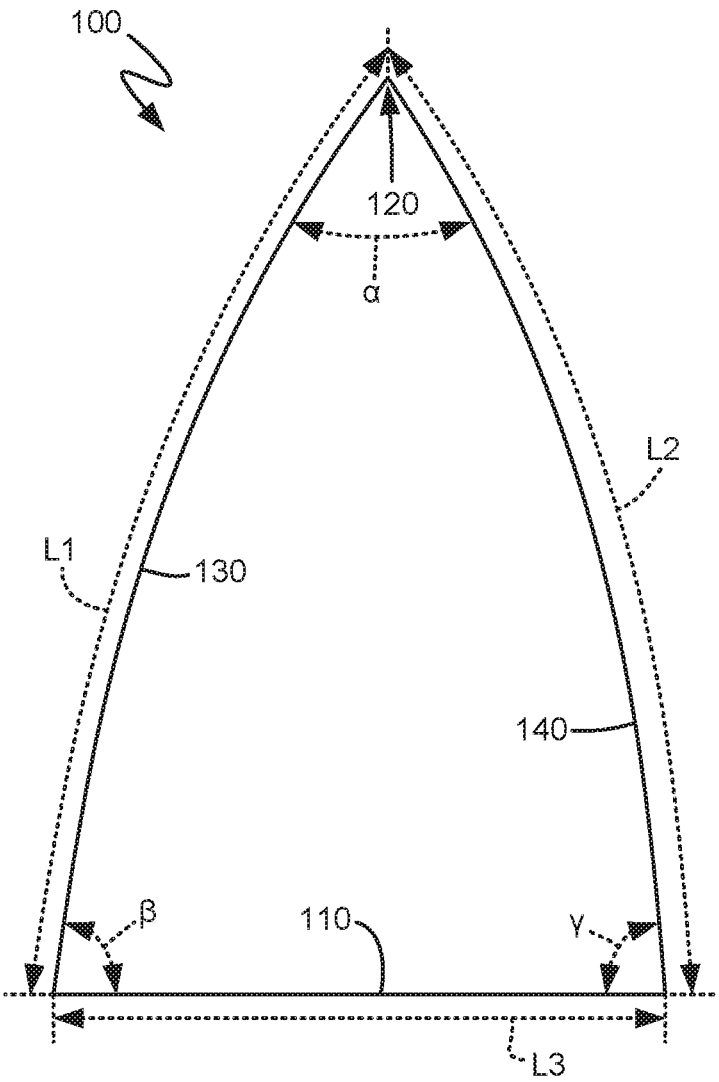
FIG. 1 is a front elevation view of a flexible ballistic panel according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
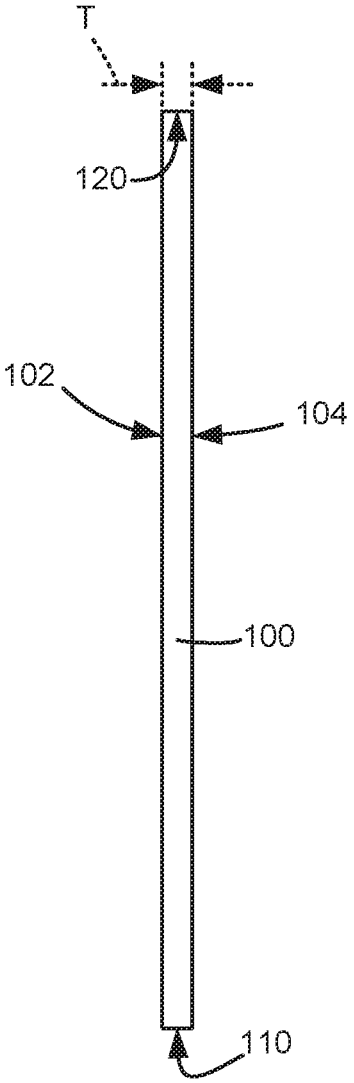
FIG. 2 is a side elevation view of the example flexible ballistic panel of FIG. 1.

FIG. 1 is a front elevation view of a soft or flexible ballistic panel 100 according to an example embodiment of the present subject matter. FIG. 2 is a side elevation view of flexible ballistic panel 100. Flexible ballistic panel 100 may be disposed within headwear in order to protect the skull and brain of a wearer. For example, a plurality of flexible ballistic panels 100 may be disposed within headwear, such as a cap, hat, scarf, etc., and the plurality of flexible ballistic panels 100 may prevent projectiles from penetrating the skull so that underlying brain tissue is thereby protected.

Flexible ballistic panel 100 may include one or more ballistic materials, and flexible ballistic panel 100 is configured to protect against assaults with handguns. Flexible ballistic panel 100 and associated headwear may be suitable for extended daily wear. Thus, flexible ballistic panel 100 and associated headwear may be worn by law enforcement officers while executing their daily duties.

As may be seen in FIG. 1, flexible ballistic panel 100 may have a generally triangular shape with three sides. One side of flexible ballistic panel 100 may be generally rectilinear, and the two other sides of flexible ballistic panel 100 may be curvilinear. Such shape of flexible ballistic panel 100 may assist with allowing flexible ballistic panels 100 within headwear to provide three hundred and sixty degrees (360°) of head protection while also being comfortable to wear.

In FIG. 1, flexible ballistic panel 100 has a bottom edge 110, an acutely pointed head 120, a first side edge 130 and a second side edge 140. First and second side edges 130 extend from bottom edge 110 to acutely pointed head 120. Bottom edge 110 of flexible ballistic panel 100 may be flat or rectilinear, and first and second side edges 130, 140 of flexible ballistic panel 100 may be arcuate or curved. Thus, e.g., flexible ballistic panel 100 may have a generally curvilinear triangular shape.

Flexible ballistic panel 100 is constructed of a fiber material that is resistant to penetration by projectiles, such as bullets. As an example, flexible ballistic panel 100 may be constructed of or with a fabric having one or more of ultra-high-molecular-weight polyethylene fibers and para-aramid fibers. In certain example embodiments, the ultra-high-molecular-weight polyethylene fibers may be Dyneema® or Spectra® brand fibers, and the para-aramid fibers may be Kevlar® brand fibers. The fiber material within flexible ballistic panel 100 may be more comfortable for extended wear relative to hard armor panels.

Flexible ballistic panel 100 may include multiple layers of strong, ballistic-resistant fibers that engage and deform a projectile in order to spreading a force of the projectile over a larger portion of flexible ballistic panel 100, relative to an undeformed projectile. Flexible ballistic panel 100 can absorb energy from the deforming projectile and stop the projectile before the projectile completely penetrates the flexible ballistic panel 100. In certain example embodiments, flexible ballistic panel 100 may conform to the NIJ Type IIIa standard and thus protect against penetration by the bullets described in such standard. Thus, e.g., flexible ballistic panel 100 may stop .357 SIG and .44 Magnum ammunition fired from longer barrel handguns.

Figure 3:
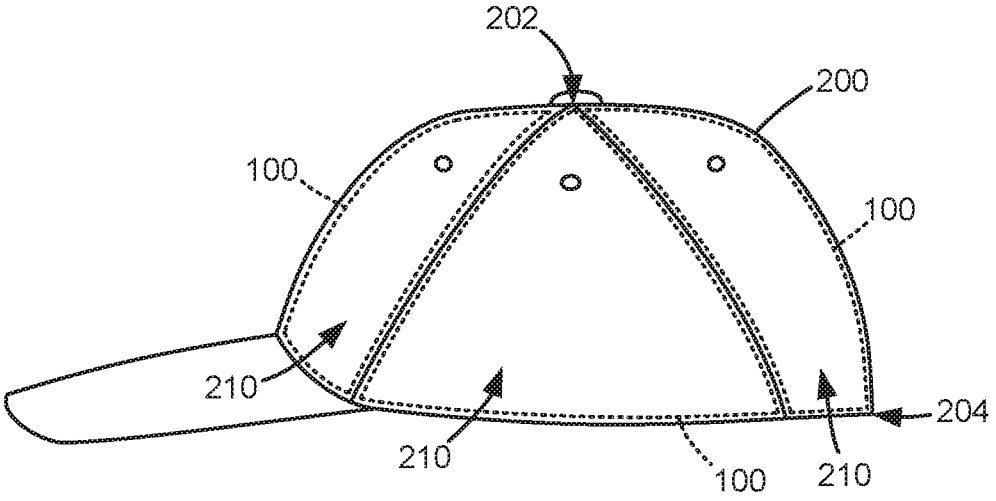
FIG. 3 is a side elevation view of a fabric cap with a plurality of the example flexible ballistic panels of FIG. 1 positioned within the fabric cap.

As shown in FIG. 2, flexible ballistic panel 100 has a thickness T, e.g., between a front surface 102 and a rear surface 104 of flexible ballistic panel 100. Rear surface 104 of flexible ballistic panel 100 may face towards an interior 206 of a fabric cap 200 (FIG. 3). Conversely, front surface 102 of flexible ballistic panel 100 may face away from interior 206 of fabric cap 200. Thus, front surface 102 may be positioned opposite rear surface 104 on flexible ballistic panel 100. As an example, the thickness T of flexible ballistic panel 100 may be about one centimeter (1 cm). As used herein, the term "about" means within ten percent of the stated thickness when used in the context of thicknesses. Such sizing of the thickness T of flexible ballistic panel 100 may advantageously provide comfortable protection during extended wear.

Flexible ballistic panel 100 may also be shaped to suitably protect a wearer. For example, first side edge 130 has a first length L1, e.g., between bottom edge 110 and acutely pointed head 120, and second side edge 140 has a second length L2, e.g., between bottom edge 110 and acutely pointed head 120. Bottom edge 110 has a third length L3, e.g., between first and second side edges 130, 140. A ratio of the first length L1 to the second length L2 may be about 18:18.5, and a ratio of the third length L3 to the first length L1 may be about 2:3. As used herein, the term "about" means within ten percent of the stated ratio when used in the context of ratios. As a particular example, the first length L1 may be about eighteen centimeters (18 cm), the second length L2 may be about eighteen and a half centimeters (18.5 cm), and the third length L3 may be about twelve centimeters (12 cm). As used herein, the term "about" means within ten percent of the stated length when used in the context of lengths. Such sizing of flexible ballistic panel 100 may advantageously allow flexible ballistic panel 100 to fit within headwear while providing desirable protection for a wearer.

The bottom edge 110, first side edge 130 and second side edge 140 may also be oriented to suitably protect a wearer. For example, first and second side edges 130, 140 define an angle $\alpha$, e.g., at or adjacent acutely pointed head 120. Similarly, bottom edge 110 and first side edge 130 define an angle $\beta$, e.g., at or adjacent and intersection of bottom edge 110 and first side edge 130, and bottom edge 110 and second side edge 140 define an angle $\gamma$, e.g., at or adjacent and intersection of bottom edge 110 and second side edge 140. As a particular example, the angle $\alpha$ may be about fifty degrees (50°), the angle $\beta$ may be about eighty degrees (80°), and the angle $\gamma$ may be about eighty degrees (80°). As used herein, the term "about" means within five degrees of the stated angle when used in the context of angles. Such angling of the edges or flexible ballistic panel 100 may advantageously allow flexible ballistic panel 100 to fit within headwear while providing desirable protection for a wearer.

Figure 4:
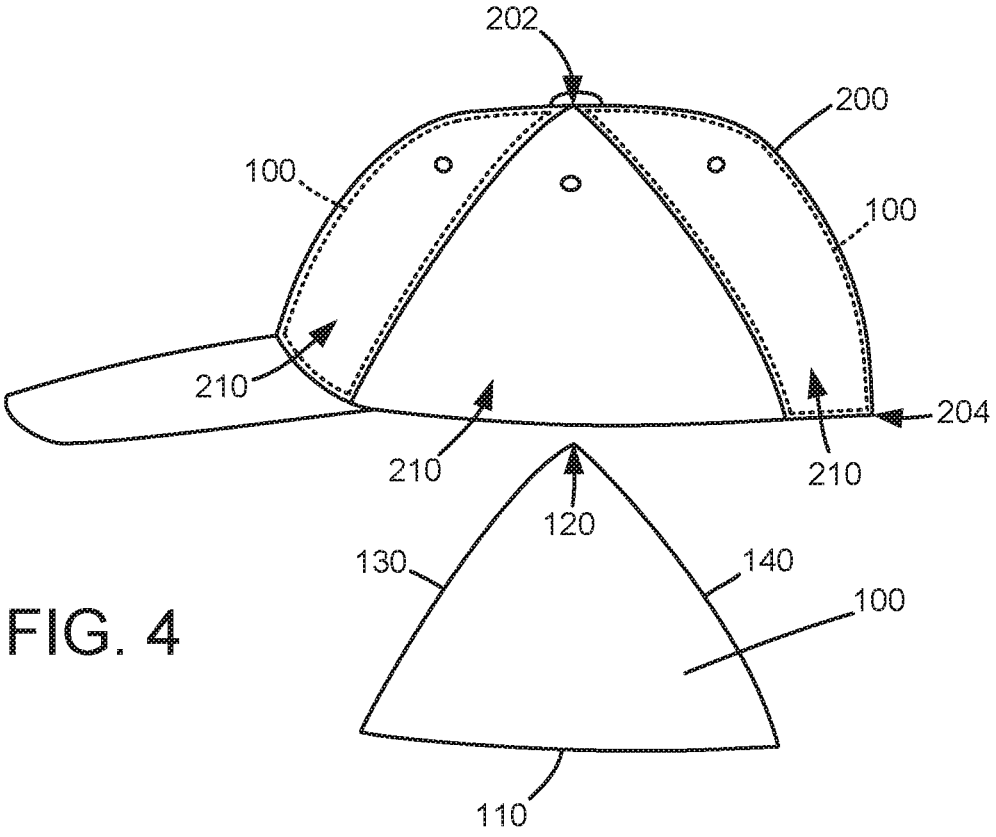
FIG. 4 is a side elevation view of the fabric cap of FIG. 3 with one of the plurality of example flexible ballistic panels removed from the fabric cap.

FIG. 3 is a side elevation view of a fabric cap 200 with a plurality of flexible ballistic panels 100 positioned within fabric cap 200. Each flexible ballistic panel 100 in fabric cap 200 may be constructed in the same or similar manner to that described above for flexible ballistic panel 100 in FIGS. 1 and 2. FIG. 4 is a side elevation view of fabric cap 200 with one of flexible ballistic panels 100 removed from fabric cap 200. As discussed in greater detail below, flexible ballistic panels 100 in fabric cap 200 protect a wearer of fabric cap 200 from brain damage due to projectiles, such as bullets.

Fabric cap 200 may be constructed to match the appearance of known headwear, such as a baseball cap, a casquette, a combination cap, a boonie hat, a patrol cap, a ranger hat, etc. Thus, e.g., fabric cap 200 may be constructed of various fabric panels stitched together. Fabric cap 200 may include one or more of para-aramid fibers, polyester fibers, cotton fibers, wool fibers, etc. As may be seen from the above, fabric cap 200 may have a covert and unassuming appearance. Thus, fabric cap 200 with flexible ballistic panels 100 may be worn to provide protection from brain damage due to projectiles, such as bullets, while also avoiding the aggressive or militaristic appearance of known helmets.

Flexible ballistic panels 100 are positioned within fabric cap 200. For example, flexible ballistic panels 100 may include no less than six (6) flexible ballistic panels 100. In certain example embodiments, flexible ballistic panels 100 may include exactly six (6) flexible ballistic panels 100. Within fabric cap 200, the acutely pointed head 120 of each flexible ballistic panel 100 is positioned adjacent a top portion 202 of fabric cap 200, and the bottom edge 110 of each flexible ballistic panel 100 is positioned adjacent a bottom portion 204 of fabric cap 200. In addition, the first side edge 130 of each flexible ballistic panel 100 may be positioned at or adjacent the second side edge 140 of an adjacent flexible ballistic panel 100 within fabric cap 200. Thus, e.g., flexible ballistic panels 100 may be distributed in a generally semi-spherical pattern within fabric cap 200. In particular, flexible ballistic panels 100 may be distributed three-hundred and sixty degrees (360°) around an interior 206 of fabric cap 200, e.g., in a plane that is perpendicular to an axis between the top and bottom portions 202, 204 of fabric cap 200. In such a manner, e.g., flexible ballistic panels 100 may be positioned in fabric cap 200 to cover anterior, lateral and posterior skull bones when fabric cap 200 on a wearer.

As shown in FIG. 3, each flexible ballistic panel 100 is removable from fabric cap 200. As an example, fabric cap 200 includes a plurality of pockets 210. A respective one of flexible ballistic panels 100 is removably positioned within each pocket 210. Thus, e.g., flexible ballistic panels 100 may be removed from fabric cap 200 to allow cleaning of fabric cap 200, replacement of one or more or flexible ballistic panels 100, etc. In alternative example embodiments, flexible ballistic panels 100 may be attached to (e.g., sewn, adhered, riveted, etc.) fabric cap 200 such that flexible ballistic panels 100 are not removable from fabric cap 200.

Figure 7:
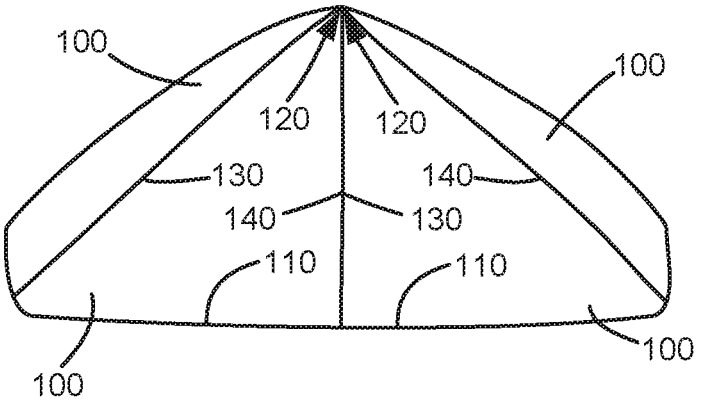
FIG. 7 is a perspective view of the flexible ballistic panels of FIG. 6.
Figure 8:
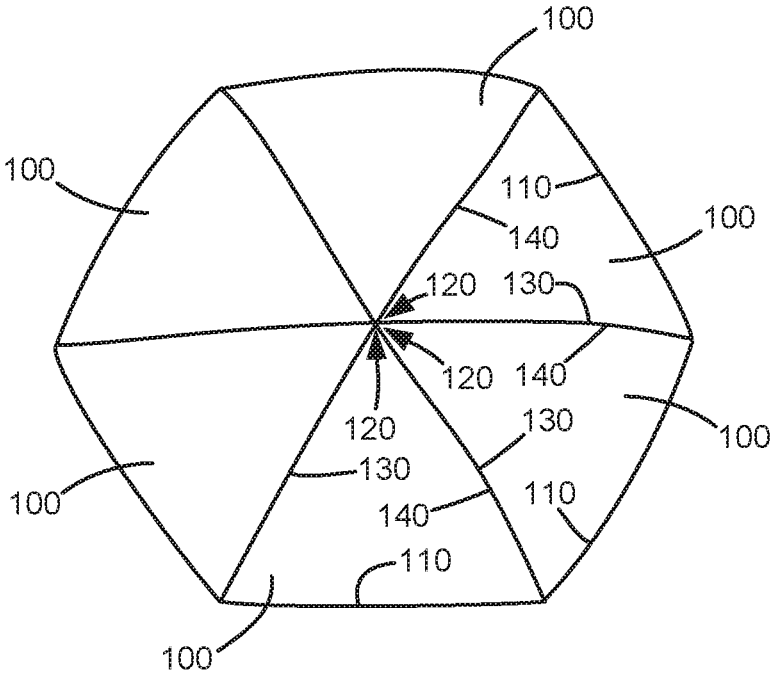
FIG. 8 is a top plan view of the flexible ballistic panels of FIG. 6.

FIG. 5 is a side elevation view of fabric cap 200 with a plurality of flexible ballistic panels 100 positioned within fabric cap 200. FIG. 6 is a side elevation view of fabric cap 200 with flexible ballistic panels 100 removed from fabric cap 200. FIG. 7 is a perspective view of the flexible ballistic panels 100, and FIG. 8 is a top plan view of the flexible ballistic panels 100. In FIGS. 5 through 8, flexible ballistic panels 100 are attached to one another, e.g., sewn together. Thus, flexible ballistic panels 100 are collectively removeable from fabric cap 200. In particular, flexible ballistic panels 100 may be attached to form a covert cap as shown in FIGS. 7 and 8, and such covert cap of flexible ballistic panels 100 may be worn with various headwear without requiring specialized mounting features within the headwear. Conversely, in FIGS. 3 and 4 discussed above, flexible ballistic panels 100 may be independently removeable from fabric cap 200. Thus, flexible ballistic panels 100 shown in FIGS. 3 and 4 may require specialized mounting features within fabric cap 200.

In FIGS. 5 through 8, each flexible ballistic panel 100 may be attached to an adjacent flexible ballistic panel 100. For example, the acutely pointed head 120 of each flexible ballistic panel 100 may be attached (e.g., sewn, adhered, riveted, etc.) to the acutely pointed head 120 of adjacent flexible ballistic panels 100. In addition, the first side edge 130 of each flexible ballistic panel 100 may be attached (e.g., sewn, adhered, riveted, etc.) to the second side edge 140 of an adjacent flexible ballistic panel 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A ballistic garment, comprising:

a plurality of flexible ballistic panels, each of the plurality of flexible ballistic panels having a bottom edge and an acutely pointed head that is spaced from the bottom edge, the plurality of flexible ballistic panels attached to one another to form a cap, the acutely pointed head of each of the plurality of flexible ballistic panels positioned adjacent a top portion of the cap, the bottom edge of each of the plurality of flexible ballistic panels positioned adjacent a bottom portion of the cap, wherein the plurality of flexible ballistic panels comprises no less than six flexible ballistic panels, wherein each of the plurality of flexible ballistic panels has a first side edge and a second side edge, the first and second side edges extending from the bottom edge to the acutely pointed head in each of the plurality of flexible ballistic panels, wherein the first side edge of each of the plurality of flexible ballistic panels is positioned at, contacts, and is directly attached to the second side edge of an adjacent one of the plurality of flexible ballistic panels, and wherein each of the plurality of flexible ballistic panels is constructed of a bullet resistant material.

2. The ballistic garment of claim 1, wherein the bottom edge of each of the plurality of flexible ballistic panels is flat, and the first and second side edges of each of the plurality of flexible ballistic panels are curved.

3. The ballistic garment of claim 2, wherein the bottom edge of each of the plurality of flexible ballistic panels has a length of about twelve centimeters, the first side edge of each of the plurality of flexible ballistic panels has a length of about eighteen centimeters, and the second side edge of each of the plurality of flexible ballistic panels has a length of about eighteen and a half centimeters.

4. The ballistic garment of claim 2, wherein the first and second side edges of each of the plurality of flexible ballistic panels define an angle that is about fifty degrees, the first side edge and the bottom edge of each of the plurality of flexible ballistic panels define an angle of about eighty degrees, and the second side edge and the bottom edge of each of the plurality of flexible ballistic panels define an angle of about eighty degrees.

5. The ballistic garment of claim 1, wherein the first side edge of each of the plurality of flexible ballistic panels has a first length, the second side edge of each of the plurality of flexible ballistic panels has a second length, the bottom edge of each of the plurality of flexible ballistic panels has a third length, a ratio of the first length to the second length is about 18:18.5, and a ratio of the third length to the first length is about 2:3.

6. The ballistic garment of claim 1, wherein a thickness of each of the plurality of flexible ballistic panels is about one centimeter.

7. The ballistic garment of claim 1, wherein each of the plurality of flexible ballistic panels conforms to the NIJ Type IIIa standard.

8. The ballistic garment of claim 1, wherein each of the plurality of flexible ballistic panels comprises a fabric with one or more of ultra-high-molecular-weight polyethylene fibers and para-aramid fibers.

9. The ballistic garment of claim 1, wherein the plurality of flexible ballistic panels are positioned on the to cover anterior, lateral and posterior skull bones when the is on a wearer.

10. The ballistic garment of claim 1, wherein the plurality of flexible ballistic panels are distributed three-hundred and sixty degrees around an interior of the cap in a plane that is perpendicular to an axis between the top and bottom portions of the cap.

11. The ballistic garment of claim 1, wherein the first side edge of each of the plurality of flexible ballistic panels is sewn, adhered, or riveted directly to the second side edge of the adjacent one of the plurality of flexible ballistic panels.

12. The ballistic garment of claim 1, wherein each of the plurality of flexible ballistic panels comprises a plurality of fabric layers, the plurality of fabric layers constructed of one or more of ultra-high-molecular-weight polyethylene fibers and para-aramid fibers.

13. A ballistic garment, comprising:

a plurality of flexible ballistic panels, each of the plurality of flexible ballistic panels having a bottom edge and an acutely pointed head that is spaced from the bottom edge, the plurality of flexible ballistic panels attached to one another to form a cap, the acutely pointed head of each of the plurality of flexible ballistic panels positioned adjacent a top portion of the cap, the bottom edge of each of the plurality of flexible ballistic panels positioned adjacent a bottom portion of the cap, each of the plurality of flexible ballistic panels also having a first side edge and a second side edge, the first and second side edges extending from the bottom edge to the acutely pointed head in each of the plurality of flexible ballistic panels, the first side edge of each of the plurality of flexible ballistic panels positioned adjacent the second side edge of a respective one of the plurality of flexible ballistic panels such that the plurality of flexible ballistic panels are distributed around an interior of the cap, wherein the plurality of flexible ballistic panels comprises no less than six flexible ballistic panels, wherein the first side edge of each of the plurality of flexible ballistic panels is positioned at, contacts, and is directly attached to the second side edge of an adjacent one of the plurality of flexible ballistic panels, wherein the acutely pointed head of each of the plurality of flexible ballistic panels is directly attached to the acutely pointed head of the adjacent one of the plurality of flexible ballistic panels, and wherein each of the plurality of flexible ballistic panels is constructed of a bullet resistant material, and wherein each of the plurality of flexible ballistic panels conforms to the NIJ Type IIIa standard.

14. The ballistic garment of claim 13, wherein the bottom edge of each of the plurality of flexible ballistic panels is flat, and the first and second side edges of each of the plurality of flexible ballistic panels are curved.

15. The ballistic garment of claim 14, wherein the first and second side edges of each of the plurality of flexible ballistic panels define an angle that is about fifty degrees, the first side edge and the bottom edge of each of the plurality of flexible ballistic panels define an angle of about eighty degrees, and the second side edge and the bottom edge of each of the plurality of flexible ballistic panels define an angle of about eighty degrees.

16. The ballistic garment of claim 14, wherein the first side edge of each of the plurality of flexible ballistic panels has a first length, the second side edge of each of the plurality of flexible ballistic panels has a second length, the bottom edge of each of the plurality of flexible ballistic panels has a third length, a ratio of the first length to the second length is about 18:18.5, and a ratio of the third length to the first length is about 2:3.

17. The ballistic garment of claim 13, wherein a thickness of each of the plurality of flexible ballistic panels is about one centimeter.

* * * * *